US009623290B2

(12) United States Patent
Nakamura

(10) Patent No.: US 9,623,290 B2
(45) **Date of Patent: *Apr. 18, 2017**

(54) GOLF CLUB

(71) Applicant: DUNLOP SPORTS CO. LTD., Kobe-shi, Hyogo (JP)

(72) Inventor: Takashi Nakamura, Kobe (JP)

(73) Assignee: DUNLOP SPORTS CO. LTD., Kobe-Shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/811,456

(22) Filed: Jul. 28, 2015

(65) Prior Publication Data

US 2015/0328507 A1 Nov. 19, 2015

Related U.S. Application Data

(63) Continuation of application No. 14/094,111, filed on Dec. 2, 2013, now Pat. No. 9,119,994.

(30) Foreign Application Priority Data

Dec. 3, 2012 (JP) ..... 2012-263914

(51) Int. Cl.
*A63B 53/10* (2015.01)
*A63B 53/00* (2015.01)
(Continued)

(52) U.S. Cl.
CPC ..... *A63B 53/00* (2013.01); *A63B 53/0466* (2013.01); *A63B 53/10* (2013.01);
(Continued)

(58) Field of Classification Search
CPC . A63B 53/00; A63B 53/10; A63B 2053/0408; A63B 60/42;
(Continued)

(56) References Cited

U.S. PATENT DOCUMENTS 5,354,054 A * 10/1994 Akatsuka ..... A63B 53/04 473/289
6,478,689 B1 11/2002 Hisamatsu
(Continued)

FOREIGN PATENT DOCUMENTS

JP 11-285550 A 10/1999
JP 2000-202069 A 7/2000
(Continued)

*Primary Examiner* — Stephen Blau
(74) *Attorney, Agent, or Firm* — Birch, Stewart, Kolasch & Birch, LLP

(57) ABSTRACT

A club 2 includes a head 4, a shaft 6 and a grip 8. A club length L1 is 45 inches or greater and 48 inches or less. A ratio (Wh/Wc) of a head weight Wh to a club weight Wc is equal to or greater than 0.71. A moment of inertia Ix about an axis of a swing is equal to or less than $6.90\times10^3$ (kg·cm$^2$). However, when the club weight is defined as Wc (kg); an axial-directional distance between a grip end and a center of gravity of the club is defined as Lc (cm); and a moment of inertia about the center of gravity of the club is defined as Ic (kg·cm$^2$), the moment of inertia Ix (kg·cm$^2$) is calculated by the following formula (1).

$$Ix=Wc\times(Lc+60)^2+Ic \quad (1)$$

18 Claims, 3 Drawing Sheets

(51) Int. Cl.
*A63B 53/14* (2015.01)
*A63B 53/04* (2015.01)

(52) U.S. Cl.
CPC ..... *A63B 53/14* (2013.01); *A63B 2209/023* (2013.01); *A63B 2225/02* (2013.01)

(58) Field of Classification Search
CPC ..... A63B 2031/5227; A63B 53/14; A63B 53/0466; A63B 2209/023; A63B 2225/02
See application file for complete search history.

(56) References Cited

U.S. PATENT DOCUMENTS 7,326,125 B2 * 2/2008 Moriyama ..... A63B 53/00 473/292
7,416,495 B2 * 8/2008 Ban ..... A63B 53/00 473/292
7,850,542 B2 * 12/2010 Cackett ..... A63B 53/0466 473/316
8,241,139 B2 * 8/2012 Brekke ..... A63B 53/00 473/292
8,951,142 B2 * 2/2015 Brekke ..... G01B 5/0023 473/292
2004/0192462 A1 9/2004 Ashida et al.
2006/0009302 A1 1/2006 Oyama
2010/0041492 A1 * 2/2010 Rice ..... A63B 53/10 473/289
2012/0129622 A1 5/2012 Naruo et al.
2013/0095944 A1 4/2013 Nakamura et al.

FOREIGN PATENT DOCUMENTS

JP 2000-225215 A 8/2000
JP 2002-35186 A 2/2002
JP 2004-201911 A 7/2004
JP 2004-313781 A 11/2004
JP 2007-136067 * 6/2007
JP 2007-136067 A 6/2007
JP 2007136067 A * 6/2007
JP 2011-235024 A 11/2011
JP 2012-125485 * 7/2012
JP 2012125485 A * 7/2012
JP 2013-81688 A 5/2013

* cited by examiner

GOLF CLUB

CROSS REFERENCE

The present application is a 37 C.F.R. §1.53(b) continuation of, and claims priority to, U.S. application Ser. No. 14/094,111, filed Dec. 2, 2013. Priority is also claimed to Japanese Application No. 2012-263914 filed on Dec. 3, 2012. The entire contents of each of these applications are hereby incorporated by reference.

BACKGROUND OF THE INVENTION

Field of the Invention

The present invention relates to a golf club.

Description of the Related Art

Examples of important evaluation items for a golf club include a flight distance.

A golf club intending the increase of the flight distance has been proposed. Japanese Patent Application Laid-Open No. 2004-201911 discloses a wood club in which the rate of mass of a head to the total mass of a golf club is 73% or greater and 81% or less. Japanese Patent Application Laid-Open No. 2000-202069 discloses a golf club in which a moment of inertia at a position separated by 170 mm from a grip end is within a predetermined range.

SUMMARY OF THE INVENTION

The demand for the increase of the flight distance has been more and more increased. The present invention enables the increase of the flight distance based on a non-traditional technical thought.

It is an object of the present invention to provide a golf club having an excellent flight distance performance.

A golf club according to the present invention includes a head; a shaft; and a grip. A club length is 45 inches or greater and 48 inches or less. A ratio (Wh/Wc) of a head weight Wh to a club weight Wc is equal to or greater than 0.71. A moment of inertia Ix about an axis of a swing is equal to or less than $6.90\times10^3$ (kg·cm$^2$). When the club weight is defined as Wc (kg); an axial-directional distance between a grip end and a center of gravity of the club is defined as Lc (cm); and a moment of inertia about the center of gravity of the club is defined as Ic (kg·cm$^2$), the moment of inertia Ix (kg·cm$^2$) is calculated by the following formula (1).

$$Ix=Wc\times(Lc+60)^2+Ic \quad (1)$$

When a static moment of the club is defined as Mt, a ratio (Ix/Mt) is preferably equal to or less than 435. The static moment Mt (kg·cm) is calculated by the following formula (2).

$$Mt=Wc\times(Lc-35.6) \quad (2)$$

When an axial-directional distance between a tip of the shaft and a center of gravity of the shaft is defined as Lg, and a shaft length is defined as Ls, a ratio (Lg/Ls) is preferably 0.5 or greater and 0.67 or less.

Preferably, the head weight Wh is equal to or greater than 0.175 kg.

Preferably, a shaft weight is equal to or less than 50 g.

Preferably, a grip weight is equal to or less than 40 g.

The golf club having an excellent flight distance performance can be obtained.

BRIEF DESCRIPTION OF THE DRAWINGS

FIG. 3 illustrates a moment of inertia about an axis of a swing, or the like.

DESCRIPTION OF THE PREFERRED EMBODIMENTS

Hereinafter, the present invention will be described in detail according to the preferred embodiments with appropriate references to the accompanying drawings.

In the present application, an "axial direction" means an axial direction of a shaft.

Figure 1:
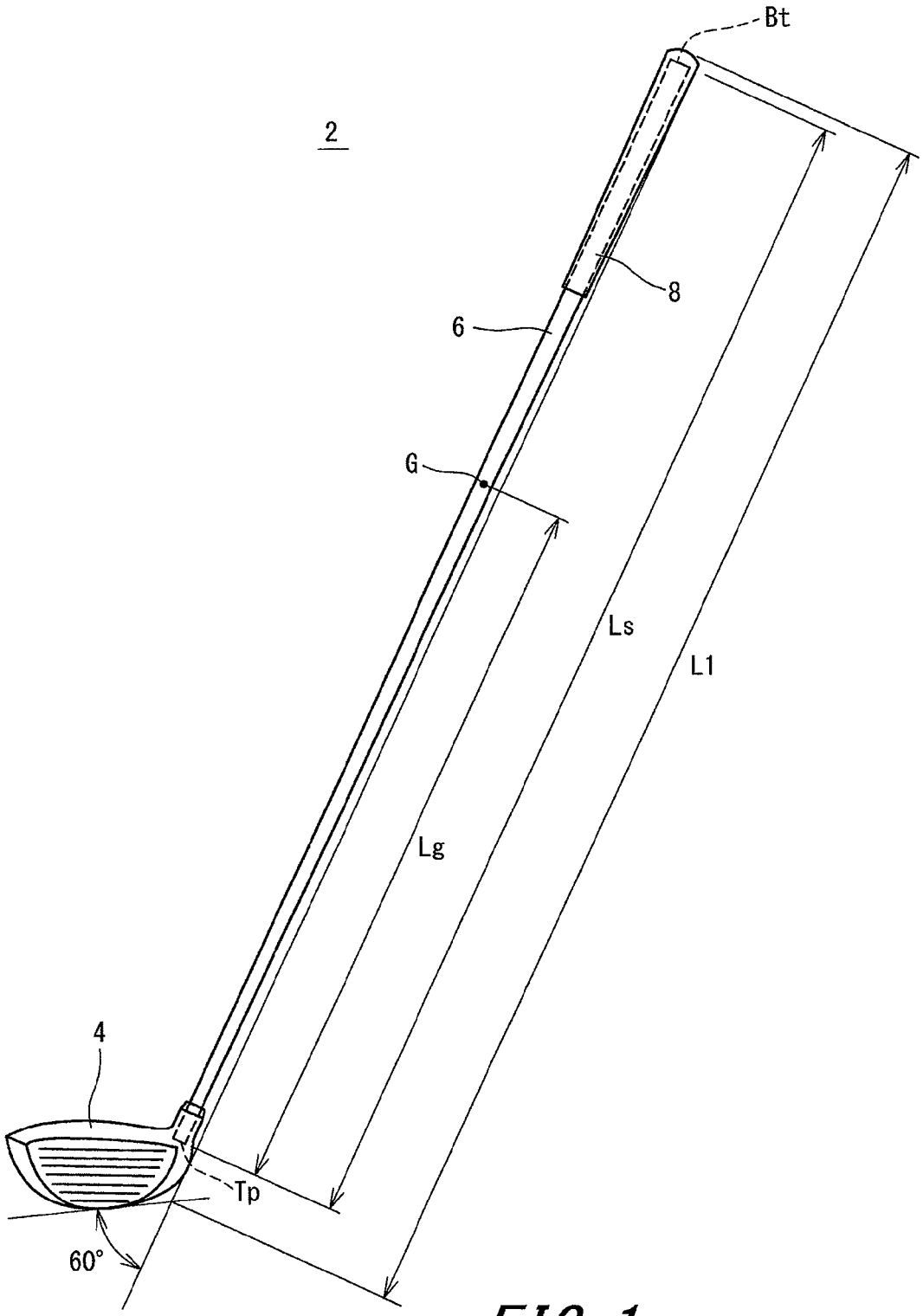
FIG. 1 shows a golf club according to an embodiment of the present invention.

FIG. 1 shows a golf club 2 according to an embodiment of the present invention. The golf club 2 includes a head 4, a shaft 6, and a grip 8. The head 4 is attached to the tip part of the shaft 6. The grip 8 is attached to the back end part of the shaft 6. The head 4 has a hollow structure. The head 4 is a wood type head.

The embodiment is effective in improvement in a flight distance performance. In this respect, preferably, the head 4 is a wood type golf club head.

The shaft 6 includes a laminate of fiber reinforced resin layers. The shaft 6 is a tubular body. The shaft 6 has a hollow structure. As shown in FIG. 1, the shaft 6 has a tip end Tp and a butt end Bt. The tip end Tp is positioned in the head 4. The butt end Bt is positioned in the grip 8.

A shaft length is represented by a double-pointed arrow Ls in FIG. 1. The shaft length Ls is an axial-directional distance between the tip end Tp and the butt end Bt. An axial-directional distance between the tip end Tp and a center of gravity G of the shaft is represented by a double-pointed arrow Lg in FIG. 1. The center of gravity G of the shaft is the center of gravity of the single shaft 6. The center of gravity G is positioned on the axis line of the shaft. A club length is represented by a double-pointed arrow L1 in FIG. 1. A method for measuring the club length L1 will be described later.

The shaft 6 is a so-called carbon shaft. The shaft 6 is preferably produced by curing the prepreg sheet. In this prepreg sheet, a fiber is oriented substantially in one direction. Thus, the prepreg in which the fiber is oriented substantially in one direction is also referred to as a UD prepreg. The term "UD" stands for uni-direction. Prepregs other than the UD prepreg may be used. For example, fibers contained in the prepreg sheet may be woven.

The prepreg sheet has a fiber and a resin. The resin is also referred to as a matrix resin. The fiber is typically a carbon fiber. The matrix resin is typically a thermosetting resin.

The shaft 6 is manufactured by a so-called sheet winding process. In the prepreg, the matrix resin is in a semicured state. The shaft 6 is obtained by winding and curing the prepreg sheet.

An epoxy resin, a thermosetting resin other than the epoxy resin, and a thermoplastic resin or the like may be used as the matrix resin of the prepreg sheet. In respect of the strength of the shaft, the matrix resin is preferably the epoxy resin.

The method for manufacturing the shaft 6 is not limited. A shaft manufactured by the sheet winding process is preferable in respects of lightweight properties and degree of design freedom.

Figure 2:
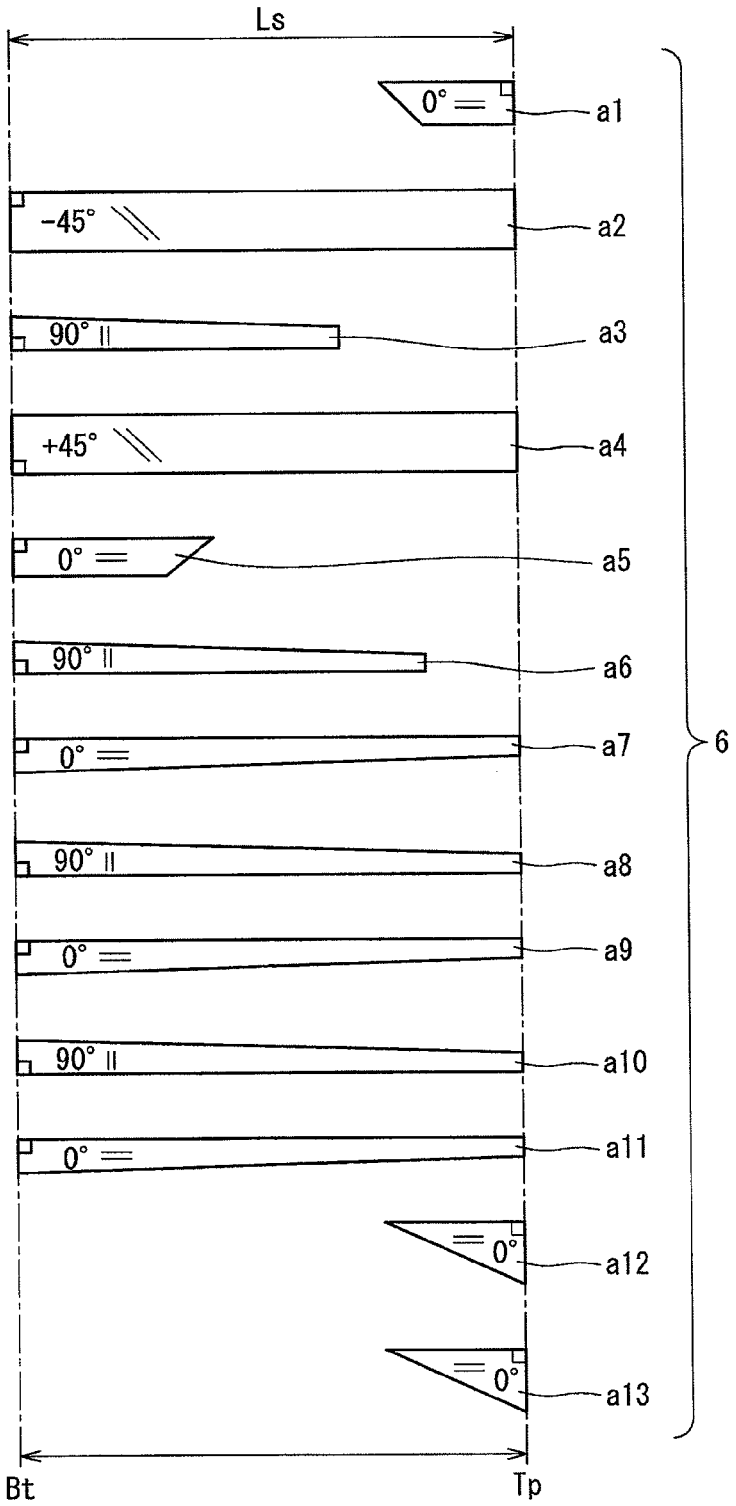
FIG. 2 is a developed view of prepreg sheets constituting a shaft used for the club of FIG. 1.

FIG. 2 is a developed view (sheet constitution view) of the prepreg sheets constituting the shaft 6. The shaft 6 includes a plurality of sheets. In the embodiment of FIG. 2, the 6 includes thirteen sheets a1 to a13. The developed view shown in FIG. 2 shows the sheets constituting the shaft in order from the radial inner side of the shaft. The sheets are wound in order from the sheet positioned on the uppermost side in the developed view. In FIG. 2, the horizontal direction of the figure coincides with the axial direction of the shaft. In FIG. 2, the right side of the figure is the tip end Tp side of the shaft. In FIG. 2, the left side of the figure is the butt end Bt side of the shaft.

The developed view shows not only the winding order of the sheets but also the arrangement of the sheets in the axial direction of the shaft. For example, in FIG. 2, the tips of the sheets a1, a12, and a13 are positioned on the tip end Tp of the shaft. For example, in FIG. 2, the back ends of the sheets a3, a5, and a6 are positioned on the butt end Bt of the shaft.

The term "layer" and the term "sheet" are used in the present application. The "layer" is termed after being wound. Meanwhile, the "sheet" is termed before being wound. The "layer" is formed by winding the "sheet". That is, the wound "sheet" forms the "layer". In the present application, the same reference numeral is used in the layer and the sheet. For example, a layer formed by the sheet a1 is the layer a1.

The shaft 6 has a straight layer, a bias layer, and a hoop layer. In the developed view of the present application, an orientation angle Af of the fiber is described for each of the sheets. The orientation angle Af is an angle relative to the axial direction of the shaft.

A sheet described as "0 degree" constitutes the straight layer. The sheet for the straight layer is also referred to as a straight sheet in the present application.

The straight layer is a layer in which the orientation of the fiber is substantially 0 degree to the axial direction of the shaft. The orientation of the fiber may not be completely set to 0 degree to the axis direction of the shaft due to an error or the like in winding. Usually, in the straight layer, an absolute angle θa is equal to or less than 10 degrees.

The absolute angle θa is an absolute value of the orientation angle Af. For example, the absolute angle θa of equal to or less than 10 degrees means that the angle Af is −10 degrees or greater and +10 degrees or less.

In the embodiment of FIG. 2, the straight sheets are the sheet a1, the sheet a5, the sheet a7, the sheet a9, the sheet a11, the sheet a12, and the sheet a13. The straight layer is highly correlated with the flexural rigidity and flexural strength of the shaft.

Meanwhile, the bias layer is highly correlated with the torsional rigidity and torsional strength of the shaft. Preferably, the bias sheet includes two sheets in which the orientations of fibers are inclined in opposite directions to each other. In respect of the torsional rigidity, the absolute angle θa of the bias layer is preferably equal to or greater than 15 degrees, more preferably equal to or greater than 25 degrees, and still more preferably equal to or greater than 40 degrees. In respects of the torsional rigidity and the flexural rigidity, the absolute angle θa of the bias layer is preferably equal to or less than 60 degrees, and more preferably equal to or less than 50 degrees.

In the shaft 6, the sheets constituting the bias layer are the sheet a2 and the sheet a4. As described above, in FIG. 2, the angle Af is described for each of the sheets. The plus (+) and minus (−) in the angle Af show that the fibers of the bias sheets are inclined in opposite directions to each other. In the present application, the sheet for the bias layer is also merely referred to as the bias sheet.

In the embodiment of FIG. 2, the angle Af of the sheet a2 is −45 degrees and the angle Af of the sheet a4 is +45 degrees. However, conversely, it should be appreciated that the angle Af of the sheet a2 may be +45 degrees and the angle Af of the sheet a4 may be −45 degrees.

In the shaft 6, the sheets constituting the hoop layer are the sheet a3, the sheet a6, the sheet a8, and the sheet a10. Preferably, the absolute angle θa in the hoop layer is substantially 90 degrees to the axis line of the shaft. However, the orientation of the fiber to the axis direction of the shaft may not be completely set to 90 degrees due to an error or the like in winding. Usually, in the hoop layer, the absolute angle θa is 80 degrees or greater and 90 degrees or less. In the present application, the prepreg sheet for the hoop layer is also referred to as a hoop sheet.

The hoop layer contributes to the increase in the crushing rigidity and crushing strength of the shaft. The crushing rigidity is rigidity to a force crushing the shaft toward the inside of the radial direction thereof. The crushing strength is a strength to a force crushing the shaft toward the inside of the radial direction thereof. The crushing strength can also be involved with the flexural strength. Crushing deformation can be generated with flexural deformation. Particularly, in a thin lightweight shaft, this interlocking property is large. The increase in the crushing strength also can cause the increase in the flexural strength.

Although not shown in the drawings, the prepreg sheet before being used is sandwiched between cover sheets. The cover sheets are usually a mold release paper and a resin film. That is, the prepreg sheet before being used is sandwiched between the mold release paper and the resin film. The mold release paper is applied on one surface of the prepreg sheet, and the resin film is applied on the other surface of the prepreg sheet. Hereinafter, the surface on which the mold release paper is applied is also referred to as "a mold release paper side surface", and the surface on which the resin film is applied is also referred to as "a film side surface".

In the developed view of the present application, the film side surface is the front side. That is, in the developed view of the present application, the front side of the figure is the film side surface, and the back side of the figure is the mold release paper side surface. In FIG. 2, the direction of a line representing the direction of the fiber of the sheet a2 is the same as that of the sheet a4. However, in the stacking to be described later, the sheet a4 is reversed. As a result, the directions of the fibers of the sheets a2 and a4 are opposite to each other. Therefore, in the state after being wound, the directions of the fibers of the sheets a2 and a4 are opposite to each other. In consideration of this point, in FIG. 2, the direction of the fiber of the sheet a2 is described as "−45 degrees", and the direction of the fiber of the sheet a4 is described as "+45 degrees".

In order to wind the prepreg sheet, the resin film is first peeled. The film side surface is exposed by peeling the resin film. The exposed surface has tacking property (tackiness). The tacking property is caused by the matrix resin. That is, since the matrix resin is in a semicured state, the tackiness is developed. Next, the edge part of the exposed film side surface (also referred to as a winding start edge part) is applied on a wound object. The winding start edge part can be smoothly applied by the tackiness of the matrix resin. The wound object is a mandrel or a wound article obtained by winding the other prepreg sheet around the mandrel. Next, the mold release paper is peeled. Next, the wound object is rotated to wind the prepreg sheet around the wound object. Thus, the resin film is first peeled. Next, the winding start edge part is applied on the wound object, and the mold release paper is then peeled. That is, the resin film is first peeled, and after the winding start edge part is applied on the wound object, the mold release paper is peeled. The procedure suppresses the wrinkles and winding fault of the sheet. This is because the sheet on which the mold release paper is applied is supported by the mold release paper, and causes less wrinkle. The mold release paper has flexural rigidity higher than that of the resin film.

A united sheet is used in the embodiment of FIG. 2. The united sheet is formed by stacking two or more sheets.

In the embodiment of FIG. 2, four united sheets are formed. A first united sheet is formed by stacking the sheet a3 and the sheet a4 on the sheet a2. In the first united sheet, the sheet a3 is sandwiched between the sheet a2 and the sheet a4. A second united sheet is formed by stacking the sheet a6 on the sheet a7. A third united sheet is formed by stacking the sheet a8 on the sheet a9. A fourth united sheet is formed by stacking the sheet a10 on the sheet a11. All the hoop sheets are wound in the state of the united sheet. The winding method suppresses the winding fault of the hoop sheet. Examples of the winding fault include the splitting of the sheet, the disturbance of the angle Af, and wrinkles.

As described above, in the present application, the sheet and the layer are classified by the orientation angle of the fiber. Furthermore, in the present application, the sheet and the layer are classified by the axial-directional length of the shaft.

In the present application, a layer disposed wholly in the axial direction of the shaft is referred to as a full length layer. In the present application, a sheet disposed wholly in the axial direction of the shaft is referred to as a full length sheet. The wound full length sheet forms the full length layer.

Meanwhile, in the present application, a layer disposed partially in the axial direction of the shaft is referred to as a partial layer. In the present application, a sheet disposed partially in the axial direction of the shaft is referred to as a partial sheet. The wound partial sheet forms the partial layer.

In the present application, the full length layer which is the straight layer is referred to as a full length straight layer. In the embodiment of FIG. 2, the full length straight layers are the sheet a7, the sheet a9, and the sheet a11.

In the present application, the full length layer which is the hoop layer is referred to as a full length hoop layer. In the embodiment of FIG. 2, the full length hoop layers are the sheet a8 and the sheet a10.

In the present application, the partial layer which is the straight layer is referred to as a partial straight layer. In the embodiment of FIG. 2, the partial straight layers are the sheet a1, the sheet a5, the sheet a12, and the sheet a13.

In the present application, the partial layer which is the hoop layer is referred to as a partial hoop layer. In the embodiment of FIG. 2, the partial hoop layers are the sheet a3 and the sheet a6.

The term "butt partial layer" is used in the present application. Examples of the butt partial layer include a butt straight layer and a butt hoop layer. In the embodiment of FIG. 2, the butt straight layer is the layer a5. In the embodiment of FIG. 2, the butt hoop layers are the layer a3 and the layer a6. The butt partial layer can contribute to the adjustment of a ratio (Lg/Ls).

The term "tip partial layer" is used in the present application. Examples of the tip partial layer include a tip straight layer. In the embodiment of FIG. 2, the tip straight layers are the layer a1, the layer a12, and the layer a13. The tip partial layer enhances the strength of the tip portion of the shaft 6. The tip partial layer can contribute to the adjustment of the ratio (Lg/Ls).

The shaft 6 is produced by the sheet winding process using the sheets shown in FIG. 2.

Hereinafter, the manufacturing process of the shaft 6 will be schematically described.

[Outline of Manufacturing Process of Shaft]

(1) Cutting Process

The prepreg sheet is cut into a desired shape in the cutting process. Each of the sheets shown in FIG. 2 is cut out by the process.

The cutting may be performed by a cutting machine, or may be manually performed. In the manual case, for example, a cutter knife is used.

(2) Stacking Process

A plurality of sheets are stacked in the stacking process to produce the four united sheets.

In the stacking process, heating or a press may be used. More preferably, the heating and the press are used in combination. In a winding process to be described later, the deviation of the sheet may occur during the winding operation of the united sheet. The deviation reduces winding accuracy. The heating and the press improve an adhesive force between the sheets. The heating and the press suppress the deviation between the sheets in the winding process.

In respect of enhancing the adhesive force between the sheets, a heating temperature in the stacking process is preferably equal to or greater than 30° C., and more preferably equal to or greater than 35° C. When the heating temperature is too high, the curing of the matrix resin may be progressed, to reduce the tackiness of the sheet. The reduction of the tackiness reduces adhesion between the united sheet and the wound object. The reduction of the adhesion may allow the generation of wrinkles, to produce the deviation of a winding position. In this respect, the heating temperature in the stacking process is preferably equal to or less than 60° C., more preferably equal to or less than 50° C., and still more preferably equal to or less than 40° C.

In respect of enhancing the adhesive force between the sheets, a heating time in the stacking process is preferably equal to or greater than 20 seconds, and more preferably equal to or greater than 30 seconds. In respect of maintaining the tackiness of the sheet, the heating time in the stacking process is preferably equal to or less than 300 seconds.

In respect of enhancing the adhesive force between the sheets, a press pressure in the stacking process is preferably equal to or greater than 300 g/cm$^2$, and more preferably equal to or greater than 350 g/cm$^2$. When the press pressure is excessive, the prepreg may be crushed. In this case, the thickness of the prepreg is made thinner than a designed value. In respect of the thickness accuracy of the prepreg, the press pressure in the stacking process is preferably equal to or less than 600 g/cm$^2$, and more preferably equal to or less than 500 g/cm$^2$.

In respect of enhancing the adhesive force between the sheets, a press time in the stacking process is preferably equal to or greater than 20 seconds, and more preferably equal to or greater than 30 seconds. In respect of the thickness accuracy of the prepreg, the press time in the stacking process is preferably equal to or less than 300 seconds.

(3) Winding Process

A mandrel is prepared in the winding process. A typical mandrel is made of a metal. A mold release agent is applied to the mandrel. Furthermore, a resin having tackiness is applied to the mandrel. The resin is also referred to as a tacking resin. The cut sheet is wound around the mandrel. The tacking resin facilitates the application of the end part of the sheet on the mandrel.

The sheets are wound in order from the sheet located on the uppermost side in the developed view of FIG. 2. The sheets stacked in the stacking process are wound in the state of the united sheet.

A winding body is obtained by the winding process. The winding body is obtained by winding the prepreg sheet around the outside of the mandrel. For example, the winding is performed by rolling the wound object on a plane. The winding may be performed by a manual operation or a machine. The machine is referred to as a rolling machine.

(4) Tape Wrapping Process

A tape is wound around the outer peripheral surface of the winding body in the tape wrapping process. The tape is also referred to as a wrapping tape. The wrapping tape is wound while tension is applied to the wrapping tape. A pressure is applied to the winding body by the wrapping tape. The pressure reduces voids.

(5) Curing Process

In the curing process, the winding body after performing the tape wrapping is heated. The heating cures the matrix resin. In the curing process, the matrix resin fluidizes temporarily. The fluidization of the matrix resin can discharge air between the sheets or in the sheet. The pressure (fastening force) of the wrapping tape accelerates the discharge of the air. The curing provides a cured laminate.

(6) Process of Extracting Mandrel and Process of Removing Wrapping Tape

The process of extracting the mandrel and the process of removing the wrapping tape are performed after the curing process. The order of the both processes is not limited. However, the process of removing the wrapping tape is preferably performed after the process of extracting the mandrel in respect of improving the efficiency of the process of removing the wrapping tape.

(7) Process of Cutting Both Ends

Both the end parts of the cured laminate are cut in the process. The cutting flattens the end face of the tip end Tp and the end face of the butt end Bt.

In order to facilitate the understanding, the developed view of FIG. 2 shows the sheets in the state where both the ends are cut. In fact, the cutting of both the ends is considered in the setting of the size of each of the sheets. That is, in fact, in the setting of the size of each of the sheets, a portion to be cut is added at both the ends.

(8) Polishing Process

The surface of the cured laminate is polished in the process. Spiral unevenness left behind as the trace of the wrapping tape exists on the surface of the cured laminate. The polishing extinguishes the unevenness as the trace of the wrapping tape to smooth the surface of the cured laminate.

(9) Coating Process

The cured laminate after the polishing process is subjected to coating.

The shaft 6 is obtained by the above processes. In the shaft 6, the ratio (Lg/Ls) is large. The shaft 6 is lightweight.

The sheet winding process has excellent degree of design freedom. The ratio (Lg/Ls) can be easily adjusted by the process. Examples of means for adjusting the ratio (Lg/Ls) include the following items (A1) to (A7).

(A1) increase or decrease of the number of windings of the butt partial layer;

(A2) increase or decrease of a thickness of the butt partial layer;

(A3) increase or decrease of an axial-directional length of the butt partial layer;

(A4) increase or decrease of the number of windings of the tip partial layer;

(A5) increase or decrease of a thickness of the tip partial layer.

(A6) increase or decrease of an axial-directional length of the tip partial layer; and (A7) increase or decrease of a taper ratio of the shaft.

In respect of increasing the ratio (Lg/Ls), the total weight of the butt partial layer is preferably equal to or greater than 5% by weight and more preferably equal to or greater than 10% by weight, based on a shaft weight Ws. In respect of suppressing a rigid feeling, the total weight of the butt partial layer is preferably equal to or less than 50% by weight and more preferably equal to or less than 45% by weight, based on the shaft weight Ws. In the embodiment of FIG. 2, the total weight of the butt partial layer is the total weight of the sheet a3, the sheet a5 and the sheet a6.

A specific butt range is defined in the present application. The specific butt range is a range from a point separated by 250 mm from the butt end Bt in the axial direction to the butt end Bt. The weight of the butt partial layer existing in the specific butt range is defined as Wa, and the shaft weight in the specific butt range is defined as Wb. In respect of increasing the ratio (Lg/Ls), a ratio (Wa/Wb) is preferably equal to or greater than 0.4, more preferably equal to or greater than 0.42, still more preferably equal to or greater than 0.43, and yet still more preferably equal to or greater than 0.44. In respect of suppressing the rigid feeling, the ratio (Wa/Wb) is preferably equal to or less than 0.7, more preferably equal to or less than 0.65, and still more preferably equal to or less than 0.6.

In the embodiment, a moment of inertia Ix is used as a novel index for the easiness of swing. In the present application, the moment of inertia Ix is referred to as a moment of inertia about an axis of a swing.

Conventionally, a swing balance (club balance) has been known as the index for the easiness of swing. However, the swing balance is a static moment, and is not a dynamic index. Meanwhile, the swing is dynamic. The moment of inertia Ix about the axis of the swing was found as the dynamic index for the easiness of swing.

Figure 3:
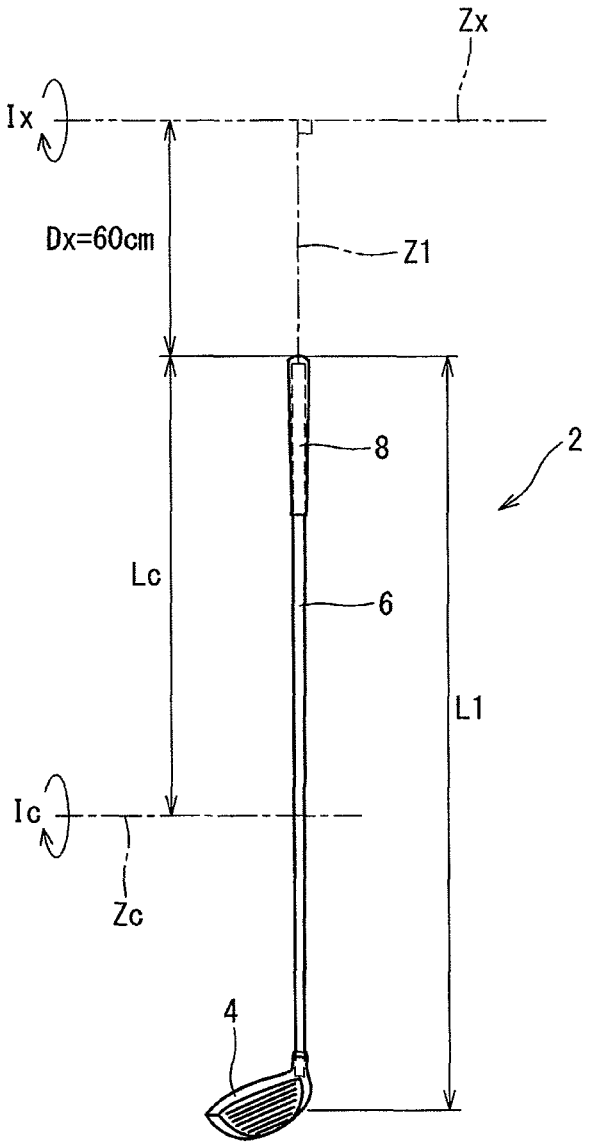

FIG. 3 illustrates the moment of inertia Ix or the like according to the present invention.

[Moment of Inertia Ix about Axis of Swing]

The moment of inertia Ix about the axis of the swing is calculated by the following formula (1).

$$Ix = Wc \times (Lc+60)^2 + Ic \quad (1)$$

In the formula (1), Wc is a club weight (kg); Lc (cm) is an axial-directional distance between a grip end and the center of gravity of the club; and Ic is a moment of inertia ($kg \cdot cm^2$) about the center of gravity of the club. The unit of the moment of inertia Ix is ($kg \cdot cm^2$).

During an actual swing, a golf club is not rotated around a grip end. The golf club is rotated with golfer's arms around a golfer's body. In the present application, a swing axis Zx is set in consideration of the position of the golfer's body during the swing. The swing axis and the grip end are separated from each other. A separation distance Dx between the swing axis Zx and the grip end was set in order to evaluate the dynamic easiness of swing (see FIG. 3). For the separation distance Dx, many golfers' body types and swings were analyzed. As a result, it was found that the suitable separation distance Dx is about 60 cm. A value of [Lc+60] was used in the formula (1) in consideration of the actual condition of the swing.

The swing is dynamic. As compared with a static index, a dynamic index can reflect the easiness of swing with accuracy. Furthermore, as described above, the actual condition of the swing is considered in the moment of inertia Ix. Therefore, in the moment of inertia Ix, the easiness of swing is reflected with higher accuracy.

An axis Zc shown in FIG. 3 passes through the center of gravity of the club. The axis Zc is parallel to the swing axis Zx. A moment of inertia Ic is a moment of inertia of the club 2 about the axis Zc. The swing axis Zx is perpendicular to an axis line Z1 of the shaft. The axis Zc is perpendicular to the axis line Z1 of the shaft. In the above-mentioned formula (1), the moment Ix is calculated by the parallel axis theorem.

In the present application, a reference state (not shown) is defined. The reference state is a state where a sole of the club 2 is placed at a prescribed lie angle and real loft angle on a level surface. In the reference state, the axis line Z1 of the shaft is included in a plane VP1 perpendicular to the level surface. The plane VP1 is defined as a reference perpendicular plane. The prescribed lie angle and real loft angle are published in catalogs of products, for example. As is clear from FIG. 3, in the measurement of each moment of inertia, a face surface is brought into a substantial square state with respect to a head path. The direction of the face surface is in an ideal impact state. The swing axis Zx is included in the reference perpendicular plane. That is, in the measurement of the moment of inertia Ix, the swing axis Zx is included in the reference perpendicular plane. In the measurement of the moment of inertia Ic, the axis Zc is included in the reference perpendicular plane. The above-mentioned each moment of inertia reflects the posture of the club near an impact. The above-mentioned each moment of inertia reflects the swing. Therefore, these moments of inertia are highly correlated with the easiness of swing. The moment of inertia Ic can be measured using MODEL NUMBER RK/005-002 manufactured by INERTIA DYNAMICS, for example.

The center of gravity of the club is considered to be positioned on the axis line Z1 of the shaft. The slight shift of the true center of gravity of the club from the axis line Z1 of the shaft is caused by the position of the center of gravity of the head. The true center of gravity of the club can be positioned in a space, for example. In the present application, a point on the axis line Z1 closest to the true center of gravity of the club is considered to be the center of gravity of the club. In other words, the center of gravity of the club in the present application is an intersection point of a perpendicular line down to the axis line Z1 from the true center of gravity of the club with the axis line Z1. The approximation of the position of the center of gravity of the club may apply a fine difference to the value of the moment of inertia Ix. However, the difference is small to the extent that it does not influence the effect described in the present application.

In respect of the easiness of swing, the moment of inertia Ix is preferably equal to or less than $6.90\times10^3$ (kg·cm$^2$), more preferably equal to or less than $6.85\times10^3$ (kg·cm$^2$), still more preferably equal to or less than $6.80\times10^3$ (kg·cm$^2$), yet still more preferably equal to or less than $6.75\times10^3$ (kg·cm$^2$), and yet still more preferably equal to or less than $6.70\times10^3$ (kg·cm$^2$). In respect of suppressing a too small shaft weight, grip weight, and/or head weight Wh, the moment of inertia Ix is preferably equal to or greater than $6.30\times10^3$ (kg·cm$^2$), and more preferably equal to or greater than $6.35\times10^3$ (kg·cm$^2$).

The easiness of swing can be improved by the decreased moment of inertia Ix. The easiness of swing contributes to improvement in a head speed. The head weight Wh is considered to be decreased as means for decreasing the moment of inertia Ix. However, if the head weight Wh is merely decreased, the kinetic energy of the head is reduced. In this case, a coefficient of restitution and a ball initial speed are reduced.

In the embodiment, Wh/Wc is increased. That is, a ratio of the head weight Wh to the club weight Wc is enhanced. The kinetic energy of the head can be increased by increasing the weight Wh distributed to the head in the club weight Wc. Therefore, the coefficient of restitution and the ball initial speed can be enhanced.

In the embodiment, the moment of inertia Ix is decreased while Wh/Wc is increased. Therefore, although the head weight Wh is large, the easiness of swing is obtained. As a result, the head speed is increased while the head weight Wh is increased. The synergy of the head weight Wh with the head speed can increase the ball initial speed and improve the flight distance performance.

The club balance is generally used as the index of the easiness of swing. If the head weight Wh is increased, the club balance also tends to be increased. For this reason, the lightening of the club balance has been considered to be the same as the lightening of the head weight Wh. A technical thought (defined as a technical thought A) in which the easiness of swing and the weight saving of the head weight Wh are be united together has existed. The technical thought A has been general in the person skilled in the art. Meanwhile, in the embodiment, a constitution in which the weight is largely distributed to the head while the club is easily to be swung is employed. Although the constitution is contrary to the technical thought A, the constitution is effective in the improvement in the flight distance performance.

In the present application, the static moment of the club is defined as Mt. The static moment Mt is calculated by the following formula (2). The unit of the static moment Mt is kg·cm.

$$Mt=Wc\times(Lc-35.6) \quad (2)$$

The static moment Mt corresponds to a 14-inch type swing balance. The swing balance is obtained by encoding the value of the static moment Mt.

In respect of decreasing Ix/Mt (to be described later) the static moment Mt is preferably equal to or greater than 14.5 kg·cm, more preferably equal to or greater than 14.7 kg·cm, still more preferably equal to or greater than 15.0 kg·cm, yet still more preferably equal to or greater than 15.3 kg·cm, and yet still more preferably equal to or greater than 15.5 kg·cm. In respect of setting the club length L1 or the like to a preferable value, the static moment Mt is preferably equal to or less than 16.5 kg·cm, more preferably equal to or less than 16.2 kg·cm, still more preferably equal to or less than 16.1 kg·cm, and yet still more preferably equal to or less than 16.0 kg·cm.

The moment of inertia Ix is preferably small with respect to the static moment Mt. That is, the ratio (Ix/Mt) is preferably small. In other words, it is preferable that the moment of inertia Ix is small and the static moment Mt is large. The constitution can decrease the moment of inertia Ix while bringing the center of gravity of the club closer to the head. Therefore, the moment of inertia Ix can be decreased while Wh/Wc is increased.

The decreased Ix/Mt means that the moment of inertia Ix is less although the static moment Mt is greater. In other words, it means that the moment of inertia Ix is less although the club balance is heavier. Therefore, the decreased Ix/Mt means that the club is easily to be swung although the club balance is heavier. As described above, the index for the easiness of swing was conventionally the club balance. Conventionally, there was a technical thought (technical thought B) in which the club was less easily to be swung if the club balance was heavier. The technical thought B could not assume a concept that the club was easily to be swung although the club balance was heavier. Therefore, conventionally, it was difficult to attain a technical thought in which Ix/Mt was decreased.

In respect of the flight distance performance, Ix/Mt is preferably equal to or less than 435 cm, more preferably equal to or less than 434 cm, still more preferably equal to or less than 433 cm, yet still more preferably equal to or less than 432 cm, and yet still more preferably equal to or less than 431 cm. In consideration of the strengths of the head, shaft, and grip, there is a limit on the decrease of the moment of inertia Ix. In consideration of the point, Ix/Mt is preferably equal or greater than 410 cm, more preferably equal or greater than 420 cm, and still more preferably equal or greater than 422 cm.

[Wh/Wc]

A weight distribution rate to the head is preferably enhanced in order to increase the kinetic energy of the head. In this respect, Wh/Wc is preferably equal to or greater than 0.71, more preferably equal to or greater than 0.72, and still more preferably equal to or greater than 0.73. In consideration of the strengths or the like of the shaft and grip, the shaft weight and the grip weight are preferably equal to or greater than a predetermined value as described above. In this respect, Wh/Wc is preferably equal to or less than 0.80, more preferably equal to or less than 0.79, and still more preferably equal to or less than 0.78.

Needless to say, in the calculation of Wh/Wc, the unit of the head weight Wh is coincided with that of the club weight Wc. If the unit of the head weight Wh is kg, the unit of the club weight Wc is also kg. If the unit of the head weight Wh is g, the unit of the club weight Wc is also g.

[Head Weight Wh]

The initial speed of the ball at the hitting can be enhanced by increasing the kinetic energy of the head. In this respect, the head weight Wh is preferably equal to or greater than 175 g (0.175 kg), more preferably equal to or greater than 180 g (0.180 kg), and still more preferably equal to or greater than 185 g (0.185 kg). In respect of the easiness of swing, the head weight Wh is preferably equal to or less than 250 g (0.250 kg), more preferably equal to or less than 245 g (0.245 kg), and still more preferably equal to or less than 240 g (0.240 kg).

[Shaft Weight Ws]

In respects of the strength and durability of the shaft, the shaft weight Ws is preferably equal to or greater than 35 g, more preferably equal to or greater than 38 g, and still more preferably equal to or greater than 40 g. In respect of enhancing Wh/Wc, the shaft weight Ws is preferably equal to or less than 50 g, more preferably equal to or less than 48 g, and still more preferably equal to or less than 46 g.

[Grip Weight Wg]

In respects of the strength and durability of the grip, a grip weight Wg is preferably equal to or greater than 20 g, more preferably equal to or greater than 23 g, and still more preferably equal to or greater than 25 g. In respect of enhancing Wh/Wc, the grip weight is preferably equal to or less than 40 g, more preferably equal to or less than 38 g, and still more preferably equal to or less than 35 g. The grip weight Wg can be adjusted by using the volume of the grip, the specific gravity of rubber, and foam rubber or the like.

[Shaft Length Ls]

In respect of increasing the rotational radius of the swing to enhance the head speed, a shaft length Ls is preferably equal to or greater than 99 cm, more preferably equal to or greater than 105 cm, still more preferably equal to or greater than 107 cm, and yet still more preferably equal to or greater than 110 cm. In respect of suppressing the variation in hit points, the shaft length Ls is preferably equal to or less than 120 cm, more preferably equal to or less than 118 cm, and still more preferably equal to or less than 116 cm.

[Distance Lg]

The easiness of swing and the head speed can be improved by bringing the center of gravity G closer to the hand. In this respect, a distance Lg (see FIG. 1) is preferably equal to or greater than 540 mm, more preferably equal to or greater than 550 mm, and still more preferably equal to or greater than 560 mm. If the distance Lg is too long, the weight which may be distributed to the tip part of the shaft is decreased. Therefore, the strength of the tip part of the shaft is apt to be reduced. In this respect, the distance Lg is preferably equal to or less than 750 mm, more preferably equal to or less than 745 mm, and still more preferably equal to or less than 740 mm.

[Lg/Ls]

In respect of decreasing the moment of inertia Ix about the axis of the swing while increasing the head weight Wh, Lg/Ls is preferably equal to or greater than 0.50, more preferably equal to or greater than 0.51, still more preferably equal to or greater than 0.52, and yet still more preferably equal to or greater than 0.53. In respect of enhancing the strength of the tip part of the shaft, Lg/Ls is preferably equal to or less than 0.67, more preferably equal to or less than 0.66, and still more preferably equal to or less than 0.65.

[Club Length L1]

In respect of enhancing the head speed, the club length L1 is preferably equal to or greater than 45 inches, more preferably equal to or greater than 45.2 inches, and still more preferably equal to or greater than 45.3 inches. In respect of suppressing the variation in the hit points, the club length L1 is preferably equal to or less than 48 inches, more preferably equal to or less than 47.5 inches, and still more preferably equal to or less than 47 inches.

The club length L1 in the present application is measured based on "1c Length" in "1 Clubs" of "Appendix II Design of Clubs" in the Golf Rules defined by R&A (Royal and Ancient Golf club of Saint Andrews).

The flight distance performance is particularly important in a driver. In this respect, the club is preferably the driver. In respect of the flight distance performance, the real loft is preferably 7 degrees or greater and 13 degrees or less. In respect of the moment of inertia of the head, the volume of the head is preferably equal to or greater than 350 cc, more preferably equal to or greater than 380 cc, still more preferably equal to or greater than 400 cc, and yet still more preferably equal to or greater than 420 cc. In respect of the strength to the head, the volume of the head is preferably equal to or less than 470 cc.

[Club Weight Wc]

In respect of enhancing Wh/Wc, the club weight Wc is preferably equal to or less than 300 g (0.300 kg), more preferably equal to or less than 295 g (0.295 kg), still more preferably equal to or less than 290 g (0.290 kg), and yet still more preferably equal to or less than 285 g (0.285 kg). In respect of the strengths of the shaft and head, the club weight is preferably equal to or greater than 250 g (0.250 kg), more preferably equal to or greater than 255 g (0.255 kg), and still more preferably equal to or greater than 260 g (0.260 kg).

EXAMPLES

Hereinafter, the effects of the present invention will be clarified by examples. However, the present invention should not be interpreted in a limited way based on the description of examples.

The following Table 1 shows examples of prepregs capable of being used for a shaft of the present invention.

TABLE 1

Examples of prepregs capable of being used

| Manufacturer | Part number of prepreg sheet | Thickness of sheet (mm) | Fiber content rate (% by mass) | Resin content rate (% by mass) | Physical property value of carbon fiber: Part number of carbon fiber | Tensile elastic modulus ($t/mm^2$) | Tensile strength ($kgf/mm^2$) |
|---|---|---|---|---|---|---|---|
| TORAY Industries, Inc. | 3255S-10 | 0.082 | 76 | 24 | T700S | 23.5 | 500 |
| TORAY Industries, Inc. | 3255S-12 | 0.103 | 76 | 24 | T700S | 23.5 | 500 |
| TORAY Industries, Inc. | 3255S-15 | 0.123 | 76 | 24 | T700S | 23.5 | 500 |
| TORAY Industries, Inc. | 805S-3 | 0.034 | 60 | 40 | M30S | 30 | 560 |
| TORAY Industries, Inc. | 2255S-10 | 0.082 | 76 | 24 | T800S | 30 | 600 |
| TORAY Industries, Inc. | 2255S-12 | 0.102 | 76 | 24 | T800S | 30 | 600 |
| TORAY Industries, Inc. | 2255S-15 | 0.123 | 76 | 24 | T800S | 30 | 600 |
| TORAY Industries, Inc. | 2256S-10 | 0.077 | 80 | 20 | T800S | 30 | 600 |
| TORAY Industries, Inc. | 2256S-12 | 0.103 | 80 | 20 | T800S | 30 | 600 |
| Nippon Graphite Fiber Corporation | E1026A-09N | 0.100 | 63 | 37 | XN-10 | 10 | 190 |
| Mitsubishi Rayon Co., Ltd. | TR350C-100S | 0.083 | 75 | 25 | TR50S | 24 | 500 |
| Mitsubishi Rayon Co., Ltd. | TR350C-125S | 0.104 | 75 | 25 | TR50S | 24 | 500 |
| Mitsubishi Rayon Co., Ltd. | TR350C-150S | 0.124 | 75 | 25 | TR50S | 24 | 500 |
| Mitsubishi Rayon Co., Ltd. | MR350C-075S | 0.063 | 75 | 25 | MR40 | 30 | 450 |
| Mitsubishi Rayon Co., Ltd. | MR350C-100S | 0.085 | 75 | 25 | MR40 | 30 | 450 |
| Mitsubishi Rayon Co., Ltd. | MR350C-125S | 0.105 | 75 | 25 | MR40 | 30 | 450 |
| Mitsubishi Rayon Co., Ltd. | MR350E-100S | 0.093 | 70 | 30 | MR40 | 30 | 450 |
| Mitsubishi Rayon Co., Ltd. | HRX350C-075S | 0.057 | 75 | 25 | HR40 | 40 | 450 |
| Mitsubishi Rayon Co., Ltd. | HRX350C-110S | 0.082 | 75 | 25 | HR40 | 40 | 450 |

A tensile strength and a tensile elastic modulus are values measured based on JIS R7601: 1986 "Test Method for Carbon Fibers".

Example 1

A shaft having the same laminated constitution as that of the shaft 6 was produced. That is, a shaft having the sheet constitution shown in FIG. 2 was produced. A manufacturing method was the same as that of the shaft 6.

In example 1, trade names of sheets and the number of windings thereof were as follows. The specifications of these products are shown in the above-mentioned Table 1.

sheet a1: TR350C-125S
sheet a2: HRX350C-075S
sheet a3: 805S-3
sheet a4: HRX350C-075S
sheet a5: TR350C-125S
sheet a6: 805S-3
sheet a7: 2256S-10
sheet a8: 805S-3
sheet a9: 2256S-10
sheet a10: 805S-3
sheet a11: TR350C-100S
sheet a12: TR350C-100S
sheet a13: TR350C-100S A commercially available driver head (XXIO7 manufactured by Dunlop sports Co. Ltd., loft: 10.5 degrees) and a grip were mounted to the obtained shaft, to produce a golf club according to the example 1. A head weight Wh was adjusted by polishing the whole outer surface of the head and using a weight adjustment adhesive. The adhesive was fixed to the inner surface of the head. The adhesive is thermoplastic. The adhesive is fixed to a predetermined position of the inner surface of the head at normal temperature. The adhesive flows at high temperature. The adhesive was set to high temperature, and was poured into the head. The adhesive was then cooled to room temperature and fixed. The adhesive was disposed so that the position of the center of gravity of the head was not changed. A grip weight Wg was adjusted by the material of the grip. The specifications of the example 1 are shown in the following Table 2.

Examples 2 to 14 and Comparative Examples 1 to 10

Clubs according to examples 2 to 14 and comparative examples 1 to 10 were obtained in the same manner as in the example 1 except that specifications shown in Tables 2 to 6 were changed. The specifications of shafts were adjusted by suitably using the adjustment means of the items (A1) to (A7) and the prepregs shown in Table 1. The specifications of the examples and comparative examples are shown in the following Tables 2 to 6.

TABLE 2

Specifications and evaluation results of examples and comparative examples

| | Unit | Comparative example 1 | Example 1 | Example 2 | Example 3 | Comparative example 2 |
|---|---|---|---|---|---|---|
| Club weight Wc | g | 242 | 247 | 257 | 262 | 267 |
| Head weight Wh | g | 170 | 175 | 185 | 190 | 195 |
| Wh/Wc | — | 0.70 | 0.71 | 0.72 | 0.73 | 0.73 |
| Club length L1 | inch | 46 | 46 | 46 | 46 | 46 |
| Lg/Ls | — | 0.513 | 0.513 | 0.513 | 0.513 | 0.513 |
| Shaft length Ls | mm | 1150 | 1150 | 1150 | 1150 | 1150 |
| Position of center of gravity of shaft Lg | mm | 590 | 590 | 590 | 590 | 590 |
| Static moment Mt | kg · cm | 14.2 | 14.7 | 15.5 | 15.9 | 16.3 |
| Position of center of gravity of club Lc | mm | 945 | 950 | 959 | 963 | 968 |
| Shaft weight Ws | g | 42.0 | 42.0 | 42.0 | 42.0 | 42.0 |
| Grip weight Wg | g | 30 | 30 | 30 | 30 | 30 |
| Moment of inertia Ix about axis of swing | kg · cm$^2$ | 6232 | 6385 | 6710 | 6870 | 7035 |
| Ix/Mt | cm | 438 | 435 | 433 | 432 | 431 |
| Head speed | m/s | 43.8 | 43.6 | 42.5 | 42.0 | 40.9 |
| Kinetic energy | J | 163.1 | 166.3 | 167.1 | 167.6 | 163.1 |
| Flight distance | yards | 218 | 223 | 224 | 225 | 218 |

TABLE 3

Specifications and evaluation results of examples and comparative examples

| | Unit | Comparative example 3 | Example 4 | Example 5 | Example 6 |
|---|---|---|---|---|---|
| Club weight Wc | g | 270 | 265 | 260 | 255 |
| Head weight Wh | g | 190 | 190 | 190 | 190 |
| Wh/Wc | — | 0.70 | 0.72 | 0.73 | 0.75 |
| Club length L1 | inch | 46 | 46 | 46 | 46 |
| Lg/Ls | — | 0.513 | 0.513 | 0.513 | 0.513 |
| Shaft length Ls | mm | 1150 | 1150 | 1150 | 1150 |
| Position of center of gravity of shaft Lg | mm | 590 | 590 | 590 | 590 |
| Static moment Mt | kg · cm | 16.1 | 16.0 | 15.9 | 15.8 |
| Position of center of gravity of club Lc | mm | 951 | 959 | 966 | 974 |
| Shaft weight Ws | g | 50.0 | 45.0 | 40.0 | 35.0 |
| Grip weight Wg | g | 30 | 30 | 30 | 30 |

TABLE 3-continued

Specifications and evaluation results of examples and comparative examples

| | Unit | Comparative example 3 | Example 4 | Example 5 | Example 6 |
|---|---|---|---|---|---|
| Moment of inertia Ix about axis of swing | kg · cm$^2$ | 6980 | 6900 | 6850 | 6780 |

TABLE 3-continued

Specifications and evaluation results of examples and comparative examples

| | Unit | Comparative example 3 | Example 4 | Example 5 | Example 6 |
|---|---|---|---|---|---|
| Ix/Mt | cm | 434 | 432 | 432 | 430 |
| Head speed | m/s | 41.5 | 41.9 | 42.1 | 42.3 |
| Kinetic energy | J | 163.6 | 166.8 | 168.4 | 170.0 |
| Flight distance | yards | 218 | 223 | 226 | 228 |

TABLE 4

Specifications and evaluation results of examples and comparative examples

| | Unit | Comparative example 4 | Example 7 | Example 8 | Example 9 |
|---|---|---|---|---|---|
| Club weight Wc | g | 274 | 267 | 257 | 252 |
| Head weight Wh | g | 190 | 190 | 190 | 190 |
| Wh/Wc | — | 0.69 | 0.71 | 0.74 | 0.75 |
| Club length L1 | inch | 46 | 46 | 46 | 46 |

TABLE 4-continued

Specifications and evaluation results of examples and comparative examples

| | Unit | Comparative example 4 | Example 7 | Example 8 | Example 9 |
|---|---|---|---|---|---|
| Lg/Ls | — | 0.513 | 0.513 | 0.513 | 0.513 |
| Shaft length Ls | mm | 1150 | 1150 | 1150 | 1150 |
| Position of center of gravity of shaft Lg | mm | 590 | 590 | 590 | 590 |
| Static moment Mt | kg · cm | 15.6 | 15.8 | 16.0 | 16.2 |
| Position of center of gravity of club Lc | mm | 925 | 948 | 980 | 998 |
| Shaft weight Ws | g | 42.0 | 42.0 | 42.0 | 42.0 |
| Grip weight Wg | g | 42 | 35 | 25 | 20 |
| Moment of inertia Ix about axis of swing | kg · cm$^2$ | 6930 | 6880 | 6850 | 6825 |
| Ix/Mt | cm | 444 | 435 | 427 | 422 |
| Head speed | m/s | 41.5 | 42.0 | 42.1 | 42.2 |
| Kinetic energy | J | 163.6 | 167.6 | 168.4 | 169.2 |
| Flight distance | yards | 218 | 225 | 226 | 227 |

TABLE 5

Specifications and evaluation results of examples and comparative examples

| | Unit | Comparative example 5 | Example 10 | Example 11 | Example 12 |
|---|---|---|---|---|---|
| Club weight Wc | g | 262 | 262 | 262 | 262 |
| Head weight Wh | g | 190 | 190 | 190 | 190 |
| Wh/Wc | — | 0.73 | 0.73 | 0.73 | 0.73 |
| Club length L1 | inch | 46 | 46 | 46 | 46 |
| Lg/Ls | — | 0.487 | 0.500 | 0.522 | 0.530 |
| Shaft length Ls | mm | 1150 | 1150 | 1150 | 1150 |
| Position of center of gravity of shaft Lg | mm | 560 | 575 | 600 | 610 |
| Static moment Mt | kg · cm | 16.0 | 16.0 | 15.9 | 15.8 |
| Position of center of gravity of club Lc | mm | 968 | 967 | 963 | 960 |
| Shaft weight Ws | g | 42.0 | 42.0 | 42.0 | 42.0 |
| Grip weight Wg | g | 30 | 30 | 30 | 30 |
| Moment of inertia Ix about axis of swing | kg · cm$^2$ | 6910 | 6880 | 6860 | 6850 |
| Ix/Mt | cm | 431 | 430 | 431 | 433 |
| Head speed | m/s | 41.5 | 41.9 | 42.0 | 42.1 |
| Kinetic energy | J | 163.6 | 166.8 | 167.6 | 168.4 |
| Flight distance | yards | 218 | 223 | 225 | 226 |

TABLE 6

Specifications and evaluation results of examples and comparative examples

| | Unit | Comparative example 6 | Comparative example 7 | Example 13 | Comparative example 8 | Example 14 | Comparative example 9 | Comparative example 10 |
|---|---|---|---|---|---|---|---|---|
| Club weight Wc | g | 262 | 267 | 262 | 262 | 247 | 262 | 247 |
| Head weight Wh | g | 190 | 195 | 190 | 190 | 175 | 190 | 175 |
| Wh/Wc | — | 0.73 | 0.73 | 0.73 | 0.73 | 0.71 | 0.73 | 0.71 |
| Club length L1 | inch | 44.5 | 44.5 | 45 | 48 | 48 | 48.5 | 48.5 |
| Lg/Ls | — | 0.514 | 0.514 | 0.514 | 0.513 | 0.513 | 0.514 | 0.514 |
| Shaft length Ls | mm | 1112 | 1112 | 1125 | 1200 | 1200 | 1213 | 1213 |
| Position of center of gravity of shaft Lg | mm | 572 | 572 | 578 | 615 | 615 | 623 | 623 |
| Static moment Mt | kg · cm | 15.1 | 15.5 | 15.3 | 17.0 | 15.7 | 17.0 | 15.9 |
| Position of center of gravity of club Lc | mm | 933 | 937 | 942 | 1004 | 990 | 1006 | 1000 |
| Shaft weight Ws | g | 42.0 | 42.0 | 42.0 | 42.0 | 42.0 | 42.0 | 42.0 |
| Grip weight Wg | g | 30 | 30 | 30 | 30 | 30 | 30 | 30 |
| Moment of inertia Ix about axis of swing | kg · cm$^2$ | 6600 | 6750 | 6680 | 7250 | 6740 | 7295 | 6830 |
| Ix/Mt | cm | 437 | 435 | 435 | 427 | 431 | 428 | 430 |
| Head speed | m/s | 41.5 | 40.9 | 41.9 | 42.0 | 43.4 | 42.2 | 43.4 |
| Kinetic energy | J | 163.6 | 163.1 | 166.8 | 167.6 | 164.8 | 169.2 | 164.8 |
| Flight distance | yards | 217 | 218 | 223 | 218 | 221 | 215 | 218 |

EVALUATION METHOD

Golfers hit balls using clubs, and flight distances and head speeds were measured. Five testers having a handicap of 10 or greater and 20 or less evaluated the clubs. Each of the five testers hit ten balls using each of the clubs. However, data of two balls with a short flight distance among the ten balls were excluded. As a result, 40 data were obtained for each of the clubs. The average values of the 40 data are shown in the above-mentioned Tables 2 to 6. The flight distance is a distance to a falling point. That is, the flight distance is so-called carry.

If Wh/Wc is too small, a kinetic energy is small, which is apt to reduce the flight distance (see comparative examples 1, 3 and 4).

If a moment of inertia Ix is too large, the head speed is low, which is apt to reduce the flight distance (see comparative examples 2, 3, 4, 5, 8 and 9).

If a club length L1 is lengthened while the head weight Wh is made heavy, the moment of inertia Ix is apt to be too large. Therefore, although the club length L1 is long, the head speed is low (see comparative example 8). As the club length L1 is longer, a meet rate is decreased, which is apt to reduce the flight distance (comparative examples 8, 9 and 10). The meet rate is the probability that the ball is hit in a sweet area.

The head weight Wh is made light, and the moment of inertia Ix is decreased. Thereby, even if the meet rate is low, the flight distance can be improved (see example 14).

If the club length L1 is too short, the head speed is apt to be reduced (see comparative examples 6 and 7). In this case, even if the head weight Wh is made heavy, the head speed is low, which is apt to reduce the flight distance (see comparative example 7).

Thus, the advantages of the present invention are apparent.

The method described above can be applied to the golf club.

The description hereinabove is merely for an illustrative example, and various modifications can be made in the scope not to depart from the principles of the present invention.

What is claimed is:

1. A golf club comprising:

a head;

a shaft having a shaft length defined as Ls, an axial-directional distance between a tip of the shaft and a center of gravity of the shaft defined as Lg, and a ratio Lg/Ls of 0.5 or greater and 0.67 or less;

a grip;

a club weight defined as Wc (kg);

an axial-directional distance between a grip end and a center of gravity of the golf club defined as Lc (cm);

a moment of inertia about an axis parallel to a virtual axis of swing and passing through the center of gravity of the golf club defined as Ic (kg·cm$^2$), and a moment of inertia Ix about the virtual axis of swing calculated by the following formula (1):

$$Ix=Wc\times(Lc+60\text{ cm})^2+Ic \quad (1),$$

wherein the moment of inertia Ix is equal to or less than $6.90\times10^3$ (kg·cm$^2$).

2. The golf club of claim 1, further comprising a head weight Wh, wherein a ratio Wh/Wc is equal to or greater than 0.71.

3. The golf club of claim 2, wherein the ratio Wh/Wc is equal to or greater than 0.72.

4. The golf club of claim 2, wherein the golf club is a driver.

5. The golf club of claim 2, wherein the golf club comprises a club length between 45 inches or greater and 48 inches or less.

6. The golf club of claim 1, wherein the golf club is a driver.

7. The golf club of claim 1, wherein the golf club comprises a club length between 45 inches or greater and 48 inches or less.

8. The golf club of claim 1, further comprising:

a static moment of the golf club defined as Mt (kg·cm) and calculated by the following formula (2):

$$Mt=Wc\times(Lc-35.6\text{ cm}) \quad (2); \text{ and}$$

a ratio Ix/Mt equal to or less than 435 cm.

9. The golf club according to claim 1, wherein a head weight Wh is equal to or greater than 0.175 kg.

10. The golf club of claim 1, wherein a shaft weight is equal to or less than 50 g.

11. The golf club of claim 1, wherein a grip weight is equal to or less than 40 g.

12. A golf club comprising:

a head;

a shaft having a shaft length defined as Ls, an axial-directional distance between a tip of the shaft and a center of gravity of the shaft defined as Lg, and a ratio Lg/Ls of 0.5 or greater and 0.67 or less;

a grip;

an axial-directional distance between a grip end and a center of gravity of the golf club defined as Lc (cm);

a club weight defined as Wc (kg);

a virtual separation distance Dx being about 60 cm;

a moment of inertia about an axis parallel to a virtual axis of swing and passing through the center of gravity of the golf club defined as Ic (kg·cm$^2$); and a moment of inertia Ix about the virtual axis of swing (kg·cm$^2$) calculated by the following formula (1):

$$Ix=Wc\times(Lc+Dx)^2+Ic \quad (1),$$

wherein the moment of inertia Ix is equal to or less than $6.90\times10^3$ (kg·cm$^2$).

13. The golf club of claim 12, further comprising a head weight Wh, wherein a ratio Wh/Wc is equal to or greater than 0.71.

14. The golf club of claim 13, wherein the ratio Wh/Wc is equal to or greater than 0.72.

15. The golf club of claim 13, wherein the golf club is a driver.

16. The golf club of claim 13, wherein a club length is 45 inches or greater and 48 inches or less.

17. The golf club of claim 12, further comprising:

a static moment of the golf club defined as Mt (kg·cm) and calculated by the following formula (2):

$$Mt=Wc\times(Lc-35.6\text{ cm}) \quad (2); \text{ and}$$

a ratio Ix/Mt equal to or less than 435 cm.

18. The golf club according to claim 12, wherein a head weight Wh is equal to or greater than 0.175 kg.

* * * * *